US008693910B2

(12) United States Patent
Sekihara et al.

(10) Patent No.: US 8,693,910 B2
(45) Date of Patent: Apr. 8, 2014

(54) IMAGE FORMING APPARATUS WITH HEATER

(75) Inventors: Yuko Sekihara, Tokyo (JP); Hiroaki Sakai, Mishima (JP); Hiroyuki Sakakibara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 207 days.

(21) Appl. No.: 13/289,615

(22) Filed: Nov. 4, 2011

(65) Prior Publication Data

US 2012/0121285 A1 May 17, 2012

(30) Foreign Application Priority Data

Nov. 15, 2010 (JP) ..... 2010-255296

(51) Int. Cl.
*G03G 15/20* (2006.01)

(52) U.S. Cl.
USPC ..... 399/67; 399/69

(58) Field of Classification Search
USPC ..... 399/67, 69, 33, 43, 328, 329
See application file for complete search history.

(56) References Cited

U.S. PATENT DOCUMENTS 6,345,169 B1 * 2/2002 Haneda et al. ..... 399/328
2004/0218943 A1 * 11/2004 Hirai et al. ..... 399/69

FOREIGN PATENT DOCUMENTS

JP 2007-212868 A 8/2007
JP 2007-256875 A 10/2007

OTHER PUBLICATIONS

Machine translation of JP 2007-212868 (published on Aug. 23, 2007) dated Jul. 22, 2013.*

* cited by examiner

*Primary Examiner* — Sophia S Chen
(74) *Attorney, Agent, or Firm* — Canon USA, Inc., IP Division

(57) ABSTRACT

An image forming apparatus includes an image forming unit, a fixing unit, and a power control unit. The image forming unit forms an unfixed image on a recording material. The fixing unit includes an endless belt, a heater held in contact with the endless belt, a pressurization roller to form a fixing nip portion for pinching and conveying the recording material together with the heater via the endless belt, and a pressure changing mechanism to effect switching between a pressurization state and a pressure release state. The power control unit controls power to the heater. In response to transitioning from the pressure release state to the pressurization state, the power control unit starts power to the heater during a transition period before the pressurization state is attained and controls power to the heater such that a heater temperature does not exceed a predetermined upper limit temperature during the transition period.

16 Claims, 10 Drawing Sheets

IMAGE FORMING APPARATUS WITH HEATER

BACKGROUND OF THE INVENTION

1. Field of the Invention

The present invention relates to an image forming apparatus such as an electrophotographic copying machine or an electrophotographic printer.

2. Description of the Related Art

As a fixing device mounted in an image forming apparatus such as an electrophotographic printer or an electrophotographic copying machine, there exists a film heating type fixing device which has a heater having a heat generating resistor on a ceramic substrate, a fixing film configured to move while held in contact with this heater, and a pressurization member configured to be pressurized with a predetermined pressurization force to thereby form a nip portion together with the heater via the fixing film. In the film heating type fixing device, while a recording material bearing an unfixed toner image is being pinched and conveyed by the nip portion, the toner image is fixed to the recording material through heating.

In an image forming apparatus in which such a fixing device is mounted, a mechanism for changing the pressurization state of the fixing film and the pressurization member (hereinafter referred to as the pressure changing mechanism) is provided as needed. This pressure changing mechanism can make the pressurization force between the fixing film and the pressurization member other than at the time of fixing lower than that at the time of fixing. The reason for providing this mechanism is to prevent setting of an elastic member such as rubber used in the fixing film and the pressurization member; such setting will occur if the fixing film and the pressurization member are kept at rest while in the pressurization state.

A fixing device provided with such a pressure changing mechanism is discussed in Japanese Patent Application Laid-Open No. 2007-256875.

Conventionally, in an image forming apparatus in which a fixing device provided with a pressure changing mechanism as discussed in Japanese Patent Application Laid-Open No. 2007-256875 is mounted, electricity supply to the heater is started after the fixing film and the pressurization member have been placed in the pressurization state, in which fixing is feasible. The reason for doing this is to prevent cracking of the heater; for, when electricity is supplied to the heater in a state in which the pressure is lower than that in the pressurization state, in which fixing is feasible, the temperature of the heater rises abruptly, resulting in cracking of the heater. In this configuration, however, the requisite time for the fixing device to attain a predetermined temperature at which fixing is feasible when starting printing (hereinafter, this requisite time will be referred to as the warm-up time) is longer by the operation time of the pressure changing mechanism, so that it is rather difficult to shorten the first print out time (hereinafter referred to as the FPOT). The FPOT is the time it takes for the first sheet to be discharged after the input of a printing start signal; it is important to shorten this FPOT from the viewpoint of usability. Thus, an image forming apparatus with a fixing device equipped with a pressure changing mechanism, which is free from cracking of the heater and capable of further shortening the warm-up time, is demanded.

SUMMARY OF THE INVENTION

The present invention is directed to an image forming apparatus capable of shortening the time before the first recording material being output while preventing the heater from being damaged.

According to an aspect of the present invention, an image forming apparatus includes: an image forming unit configured to form an unfixed image on a recording material; a fixing unit including an endless belt, a heater held in contact with an inner surface of the endless belt, a pressurization roller configured to form a fixing nip portion for pinching and conveying the recording material together with the heater via the endless belt, and a pressure changing mechanism configured to effect switching between a pressurization state in which a pressure, at a time of fixing processing, is applied to the fixing nip portion and a pressure release state in which the pressure applied to the fixing nip portion is released; and a power control unit configured to control supply of power to the heater, wherein, in response to a print signal being input to effect transition from the pressure release state to the pressurization state, the power control unit starts the supply of power to the heater during a transition period before the pressurization state is attained and controls the supply of power to the heater such that a heater temperature does not exceed a predetermined upper limit temperature during the transition period.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The first exemplary embodiment will be illustrated.

Figure 1:
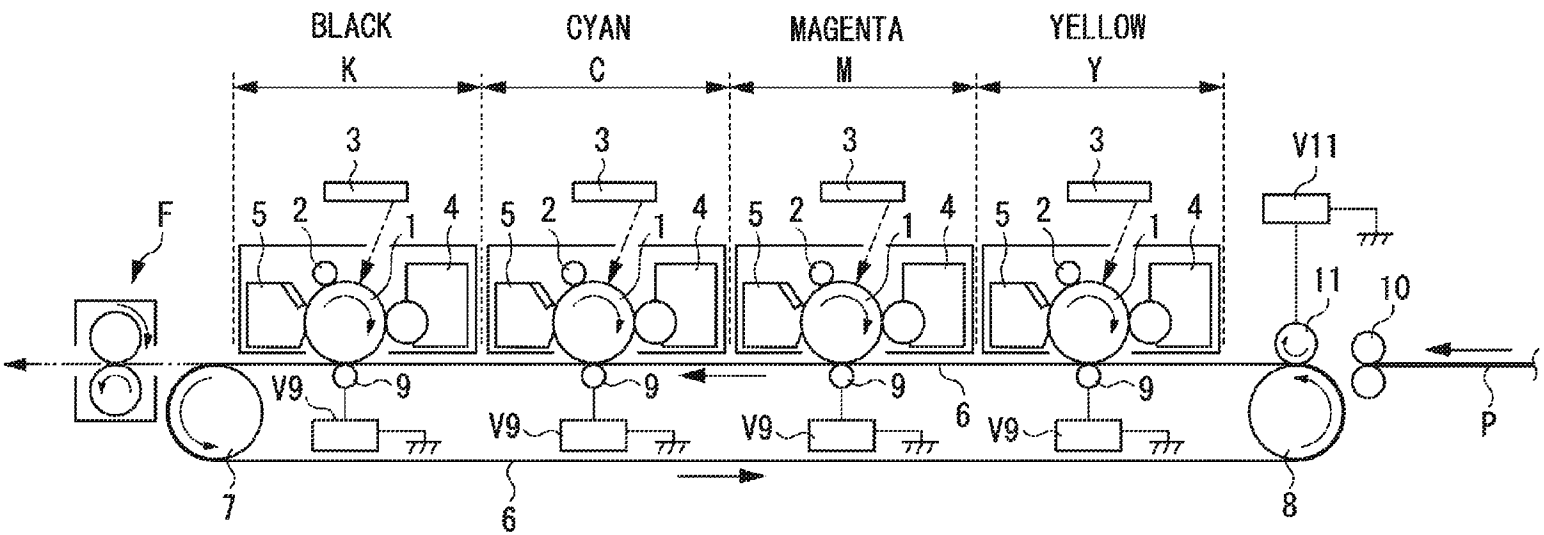
FIG. 1 is a sectional view of an image forming apparatus.

(1) An image forming apparatus will be illustrated. FIG. 1 is a sectional view of an example of an image forming apparatus. This image forming apparatus is a tandem type electrophotographic color image forming apparatus, which excels, in particular, in operating speed. In FIG. 1, symbols Y, M, C, and K respectively indicate toner image forming units (image forming units) for yellow, magenta, cyan, and black. Each unit is configured with an electrophotographic process mechanism including a rotary drum type electrophotographic photosensitive member (hereinafter referred to as the photosensitive drum) 1 serving as the image bearing member, a charger 2, a laser exposure optical system 3, a developing device 4, a cleaning device 5, etc. The photosensitive drum 1 is rotated at a predetermined peripheral speed in the direction of the arrow, and a toner image corresponding to each color is formed on the surface of the photosensitive drum by the publicly known electrophotographic image forming process.

A transfer belt 6 is stretched between a driving roller 7 and a turn roller 8. The transfer belt 6 is arranged under the units Y, M, C, and K so as to extend over all the units, and is rotated counterclockwise as indicated by the arrow at a circumferential speed corresponding to the circumferential speed of the photosensitive drum 1. Transfer rollers 9 are held in press contact with the lower surfaces of the photosensitive drums 1 and sandwiches the transfer belt 6 therebetween, to form transfer nip portions. Registration rollers 10 feed a recording material (transfer material, sheet) P fed separately from a sheet feeding mechanism portion (not illustrated) to the first unit Y side end portion of the transfer belt 6 with a predetermined control timing. The recording material P thus fed is electrostatically attached to the surface of the transfer belt 6 by an electrode roller 11.

The transfer belt 6 holds the recording material P, and conveys it successively to the transfer nip portions of the first through fourth units Y, M, C, and K. A bias application power source V11 is for the electrode roller 11. A transfer bias application power sources V9 are for the transfer rollers 9. According to this construction, a yellow toner image, a magenta toner image, a cyan toner image, and a black toner image are successively transferred to and superimposed on the surface of the same recording material P in an aligned state, whereby an unfixed full color toner image (unfixed image) is formed. After being conveyed and passed through the transfer nip portion of the fourth unit K, the recording material P is separated from the transfer belt 6, and is introduced into a fixing device F to undergo heat fixing processing of the unfixed toner images before being discharged and conveyed as a resultant sheet with a full color toner image.

Figure 2:
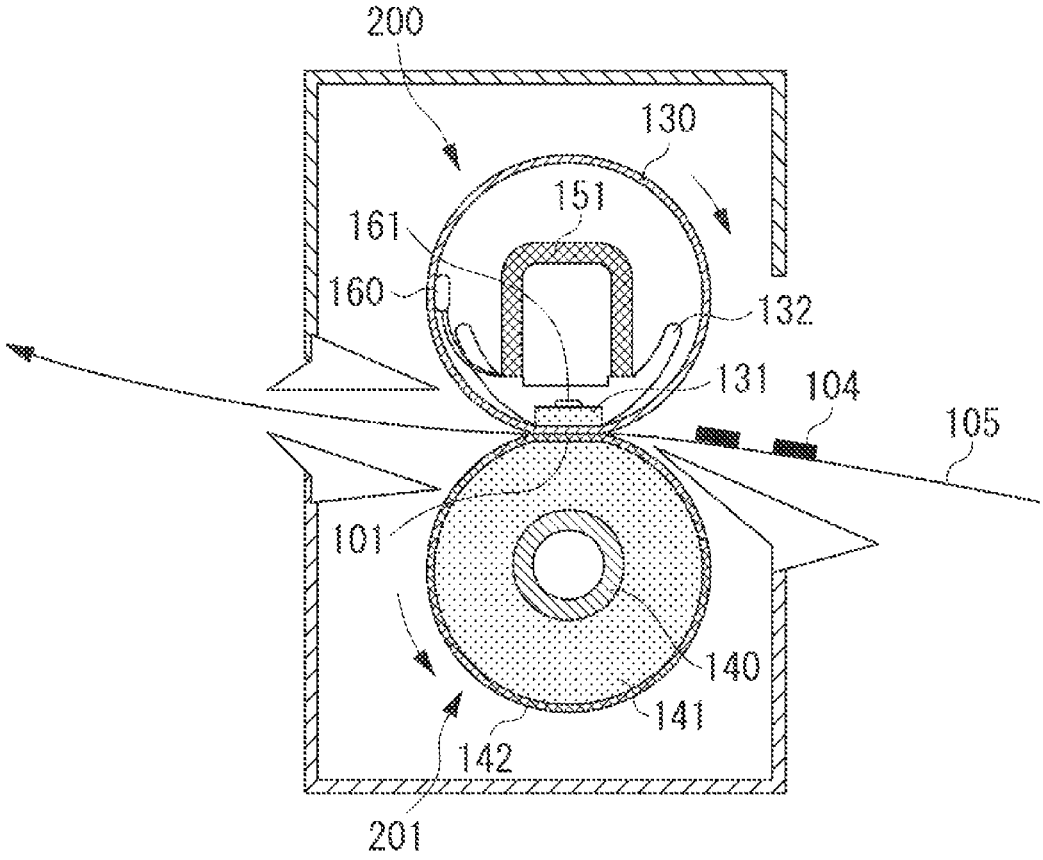
FIG. 2 is a sectional view of a fixing device.

(2) A fixing device (fixing unit) F will be illustrated. FIG. 2 is a schematic sectional view of the fixing device F. The construction of the fixing device F, which is a film heating type fixing device, will be schematically illustrated below. In FIG. 2, a heating unit 200 is equipped with a fixing belt (endless belt) 130 to be heated, and a heater 131 contained therein and serving as a heat generation source. By bringing the heater 131 into contact with the inner surface of the fixing belt 130, heat is conducted, thereby heating the fixing belt 130. In the following, the contact portion between the heater 131 and the inner surface of the fixing belt 130 will be referred to as the heater nip. A pressure roller 201 is opposed to the fixing belt 130 to be heated. The recording material is pinched and conveyed by a fixing nip portion between the fixing belt 130 and the pressure roller 201. The fixing nip portion is formed by applying pressure to the section between the heater 131 and the pressurization roller 201 via the fixing roller 130.

Figure 3A:
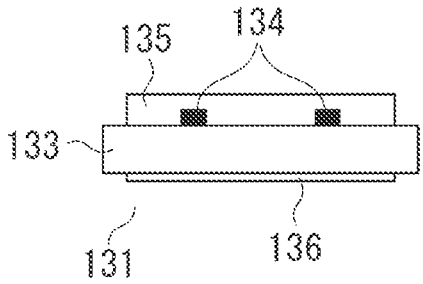
FIG. 3A is a sectional view of a heater.
Figure 3B:
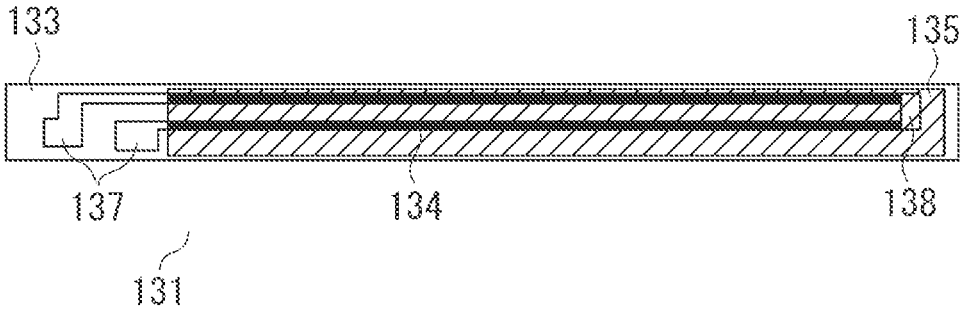
FIG. 3B is a top view of the heater.

The fixing belt 130 consists of a base layer made of stainless steel (SUS) formed into a cylinder of a thickness of 30 μm and of an inner diameter of 24 mm, a silicone rubber layer of a thickness of 30 μm provided as an elastic layer, and an outer coating tube of a thickness of 30 μm made of tetrafluoroethylene perfluoroalkyl vinyl ether (PFA) serving as a release layer. As the material of the base layer of fixing belt 130, it is also possible to employ, instead of stainless steel, a metal material such as nickel, or a heat resistant resin material such as polyimide. FIG. 3A is a sectional view of the heater 131 serving as the heating member, and FIG. 3B is a top view of the non-abutment surface side of the fixing belt 130. The heater 131 is formed by forming a heat generation resistor pattern 134 on a substrate 133 made of a ceramic material such as alumina or aluminum nitride and having a length of 270 mm, a width of 8 mm, and a thickness of 0.8 mm. In the present exemplary embodiment, the heat generation resistor pattern 134 is formed by printing on the side of the substrate surface not abutting on the fixing belt 130; and, on the heat generation resistor pattern, an insulation heat resistant glass protective layer 135 having a thickness of 80 μm is provided. On the heat generation resistor pattern 134, conductor patterns 137 and 138 are formed to connect to the heat generation resistor pattern 134, and electricity is supplied from the conductor pattern 137. Further, on the fixing belt 130 side substrate surface, a polyimide layer 136 of a thickness of 10 μm is formed to maintain a satisfactory slidability with respect to the fixing belt 130 and to prevent friction therebetween.

To control the temperature of the fixing belt 130 and the heater 131 to target values, a main thermistor (first temperature detection element) 160 serving as a temperature serving element is provided on the inner surface of the fixing belt 130, and a sub thermistor (second temperature detection element) 161 is provided on the side of the heater 131 not abutting on the fixing belt 130, each thermistor being held in an abutting arrangement. According to the detection results, the power applied is controlled so that a predetermined fixing temperature is maintained by a power control unit (not illustrated). More specifically, during the period in which the recording material undergoes fixing processing at the fixing nip portion (the period from the time T4 onward mentioned below), the power control unit controls the power applied to the heater 131 such that the detection temperature of the main thermistor 160 is maintained at the predetermined fixing temperature. On the other hand, during the period in which the fixing device is warmed up to a state in which fixing is feasible (During this period, the heater 131 is warmed up to a target temperature; this period is prior to the time T4 mentioned below); during this period, the power control unit controls the power applied to the heater 131 according to the detection temperature of the sub thermistor 161.

A holder member 132 is made of a heat resistant resin (such as liquid crystal polymer) and serves to hold the heater 131 and to guide the running of the fixing belt 130. A metal skeleton 151 supports the holder member along the longitudinal direction. The total pressurization force the metal skeleton 151 receives from the pressure changing mechanism 150, which is 225 N, is transmitted via the holder member 132 to the heater 131 so as to be longitudinally uniform, with the result that the heater 131 brings the fixing belt 130 into press contact with the pressure roller 201.

Figure 4:
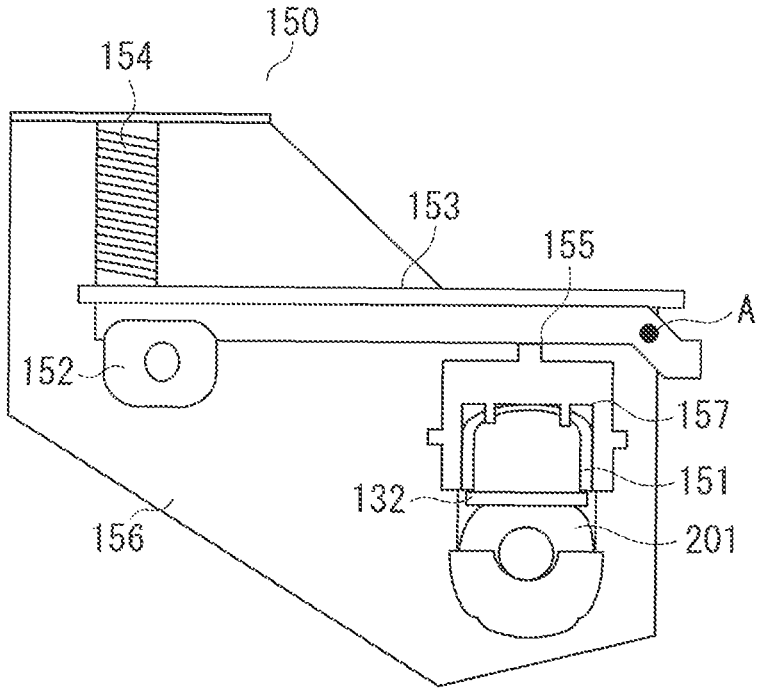
FIG. 4 is a side view of a pressure changing mechanism.

FIG. 4 is a schematic side view of the pressure changing mechanism 150. The pressure changing mechanism 150 is configured with a cam member 152, etc. Through rotation of the cam member 152, a pressurization plate 153 moves up and down using a rotation center A as a fulcrum; the pressure applied to a pressurization point 155 is varied by a compression spring 154; and the pressure applied to the metal skeleton 151 and the holder member 132 from a resin member 157 supported by a support member 156 is varied. Owing to this mechanism, it is possible to change the pressure applied to the press contact portion (fixing nip portion). During fixing processing, a pressurization force in total of 225 N is applied; when fixing processing is not being conducted, the cam member 152 rotates to relieve the pressurization force, thus serving to prevent the fixing belt 130 and the pressurization roller 201 from setting (generating residual strain). Here, the period in which fixing processing is not being performed implies the power OFF period or the sleep period of the image forming apparatus; this, however, should not be construed restrictively, and it is possible to perform the operation of relieving the pressurization force as needed. The construction of the pressure changing mechanism 150 is not restricted to the above-described one; it is also possible to adopt some other construction so long as it allows changing of the pressure applied to the press contact portion.

The pressurization roller 201 is formed by providing a silicone rubber elastic layer 141 of a thickness of 3.5 mm on an iron core 140 of an outer diameter of 18 mm, and further providing thereon a release layer 142 of a thickness of 50 μm made of PFA (Thus, the pressurization roller has an outer diameter of approximately 25 mm). The product hardness of the pressurization roller is 56 degrees (ASKER-C; load: 9.8N). The width of a fixing nip portion 101 formed through deformation of the elastic layer 141 as a result of receiving the pressurization force from the heater 131 is approximately 10 mm. In the present exemplary embodiment, the pressurization roller 201 is driven by a driving motor (not illustrated). Regarding the operation of the driving motor, its driving, stopping, and rotation speed is controlled by a control unit (not illustrated).

The fixing belt 130 is driven by the pressurization roller 201 by the frictional force exerted between the pressurization roller 201 and the fixing nip 101, and is rotated in the direction of the arrow at the same circumferential speed as the pressurization roller 201 while sliding on and held in press contact with a part of the heater 131 and the holder member 132.

In usual image formation, in which image formation is performed on an ordinary paper sheet or the like of a basis weight of 60 to 100 g/m$^2$, the pressurization roller 201 is driven at a circumferential speed of 240 mm/sec, and the electricity supply to the heater 131 is adjusted such that the temperature of the back surface of the fixing belt 130 is 190° C.

The recording material 105, which has undergone the transfer process and which has the unfixed toner image 104 thereon, is guided to the fixing nip portion, and the toner is melted by the pressure applied at the nip portion and the heat conducted from the fixing belt 130 and the heater 131, with the toner image being fixed to the recording material 105.

Figure 5A:
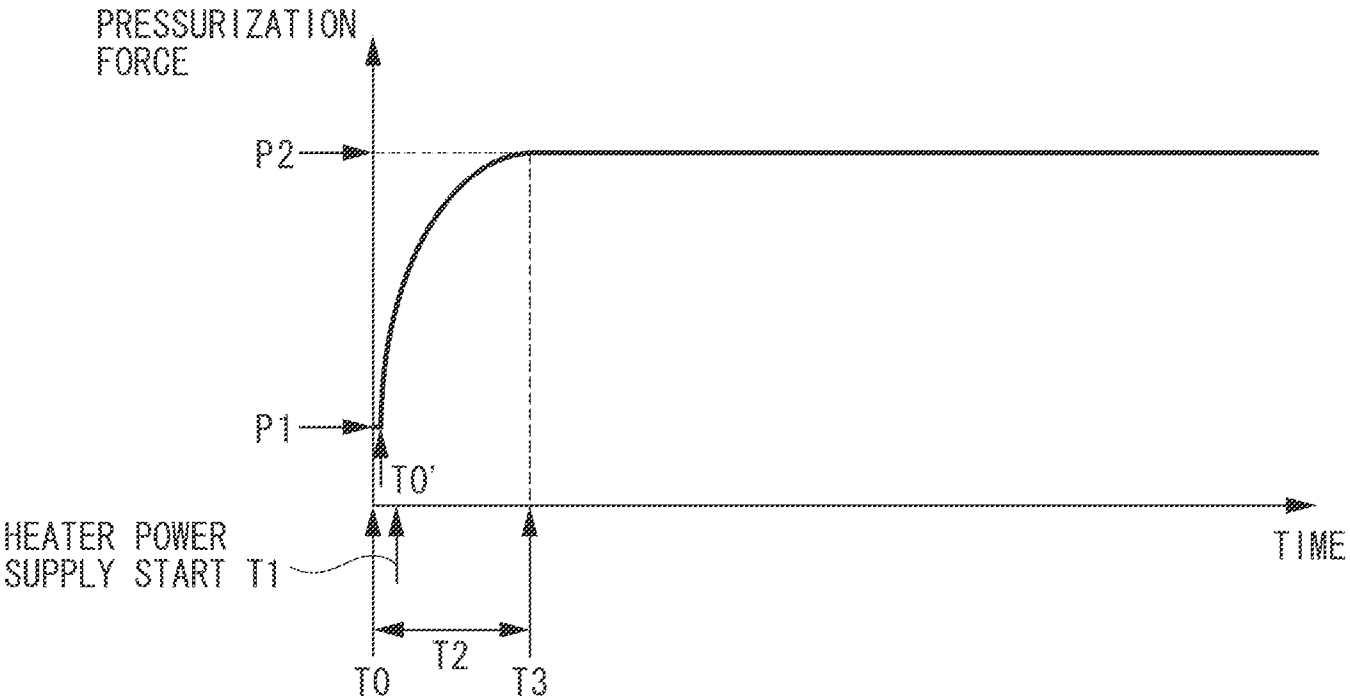
FIGS. 5A and 5B are diagrams illustrating the relationship between "pressure applied to nip portion" and "power supply timing" in a first exemplary embodiment.
Figure 5B:
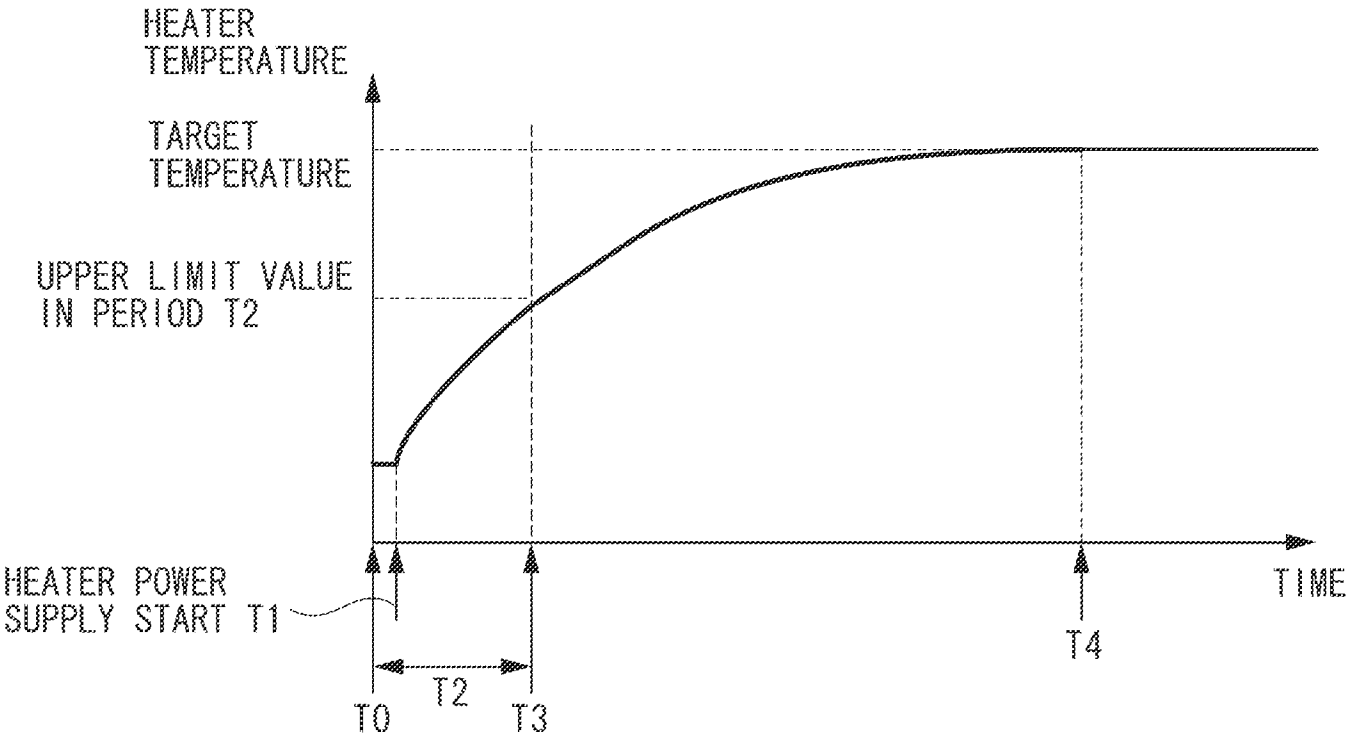

(3) The pressure changing mechanism and the power control timing will be illustrated. FIGS. 5A and 5B are diagrams illustrating the pressure condition and power control timing of the fixing device. The pressure condition and the power control timing of the fixing device, which is a feature of the present invention, will be illustrated with reference to FIGS. 5A and 5B.

First, the pressure condition of the fixing device will be illustrated with reference to FIG. 5A. First, a printing start signal is input to the image forming apparatus (This timing will be referred to as T0). Next, when the printing start signal is input, transition is immediately started by the pressure changing mechanism 150 from a pressure release state P1 (in which, in the present exemplary embodiment, the total pressure is 50 N) to a pressurization state P2 in which the pressure at the time of fixing processing is applied (in which, in the present exemplary embodiment, the total pressure is 225 N), until the pressurization state P2 is attained (This timing will be referred to as T3). Here, A delay time T0' in the control of the transition from the state P1 to P2 is the timing with which the pressurization force actually starts to be changed. In the present exemplary embodiment, it takes 0.1 seconds from T0 to T0'. Here, the term pressure release state P1 implies a state in which suppression of deformation of the pressurization roller suffices; it covers not only a non-pressure state but also a low-pressure state in which the pressure is lower than in the pressurization state P2.

At this time, the power control unit (not illustrated) starts electricity supply to the heater 131 at the timing of T1, at which the heater temperature actually rises. In the present exemplary embodiment, the maximum power applied is 1000 W. It takes 0.2 seconds from T0 to T1. Here, the timing T1 and the timing for changing of the pressurization force T0' can replace each other. Further, in order that the heater 131 may not attain a level of a fixed temperature or higher during the transition period T2 (in order that the heater temperature may not exceed a predetermined upper limit temperature), during the transition period T2, a temperature upper limit value for the heater 131 is provided separately from that during the period of the fixing processing, thus controlling the power supply.

This temperature upper limit value is provided for the purpose of preventing the heater from cracking as a result of an abrupt increase in the heater temperature. In the conventional construction, in which the power supply to the heater 131 is started after the pressurization state P2 has been attained, heat is likely to be dissipated by the sufficient pressure being applied, so that there is no fear that the temperature of the heater 131 increase abruptly. However, in the construction of the present exemplary embodiment, in which the power supply to the heater 131 is started during the transition period T2, heat is likely to be kept in the heater 131 since the pressurization force is not sufficient. Thus, there is a fear that the temperature of the heater 131 abruptly increase to cause heater cracking, therefor, before attaining the pressurization state P2, the power supply is controlled such that the temperature upper limit value is not exceeded while the temperature rising rate of the sub thermistor 161 arranged in contact with the heater 131 is monitoring. In the present exemplary embodiment, the temperature upper limit value is 120° C. However, this should not be construed restrictively; the temperature upper limit value can be changed according to the construction of the fixing device. The ultimate heater target temperature during the warm-up period (from T0 to T4) is 200° C.

FIG. 5B is a graph illustrating how the detection temperature of the sub thermistor 161, which is provided on the back surface side of the heater 131, is changed. FIG. 5B illustrates temperature transition in a case where the temperature is raised from room temperature. As illustrated in FIG. 5B, the power supply to the heater 131 is started during the transition period T2, which is from the pressure release state P1 to a point in time before attaining the pressurization state P2, so that the detected temperature of the sub thermistor 161 rises abruptly; however, when the pressurization state P2 is attained, heat is taken away by the pressurization roller 201, so that the temperature rise becomes gentle. From the timing T3 onward, the maximum power of 1000 W is supplied to the heater 131. The power supply during the transition period T2 until the timing T3 is controlled through proportional and integral (PI) control according to the detected temperature of the sub thermistor 161. Under this condition, the warm-up time in the present exemplary embodiment (the period of time up to T4) is 7.0 seconds.

Figure 6A:
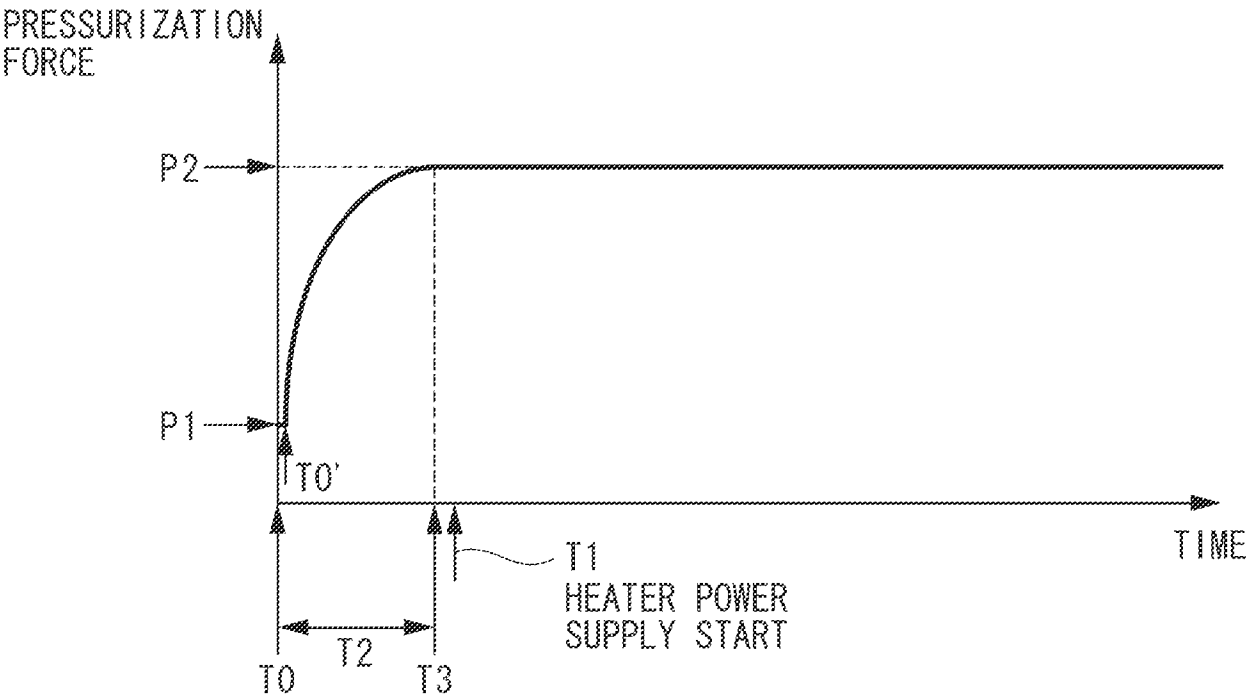
FIGS. 6A and 6B are diagrams illustrating the relationship between "pressure applied to nip portion" and "power supply timing" in a first comparative example.
Figure 6B:
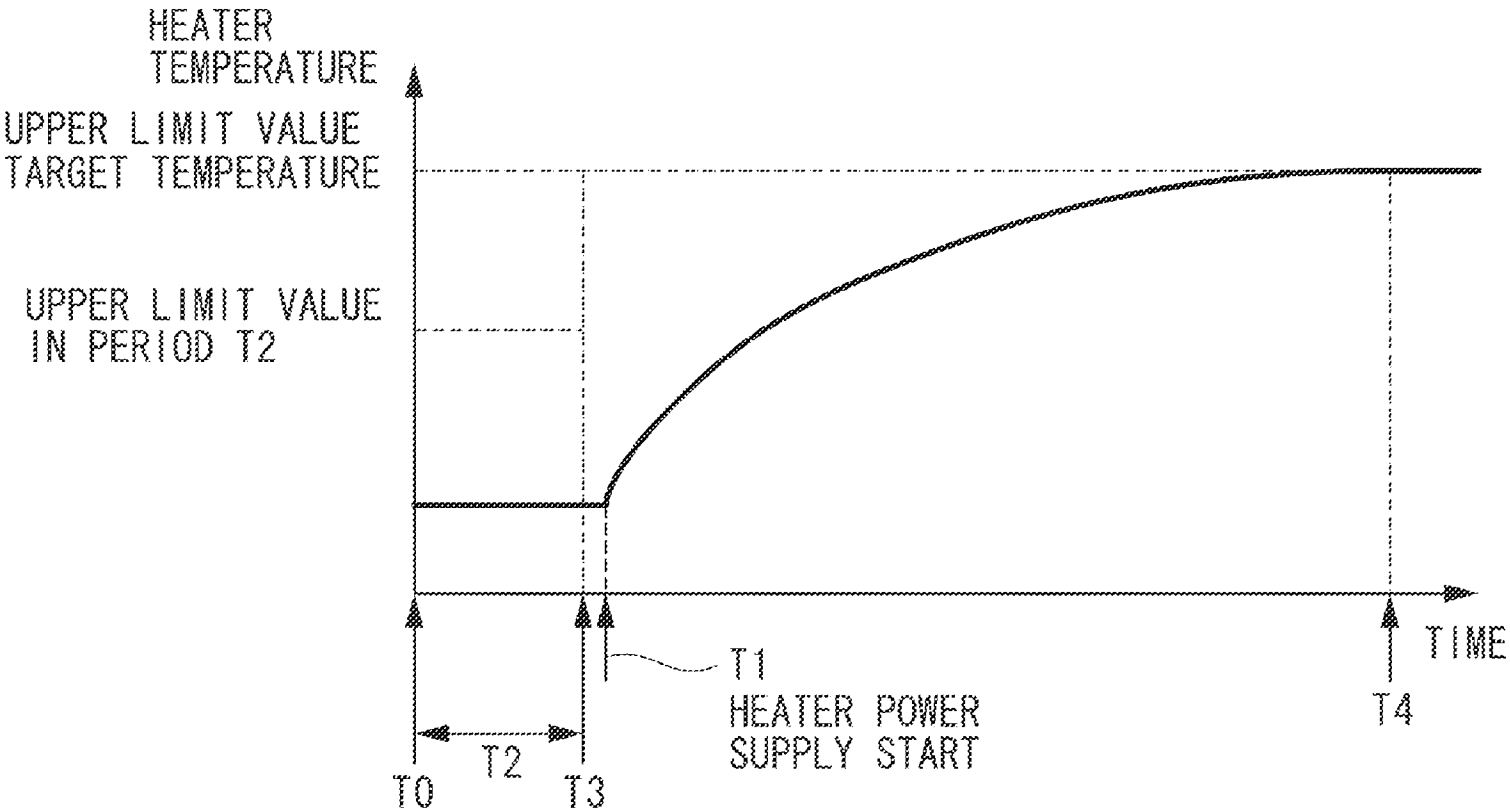

A first comparative example will be illustrated. Apart from the power supply start timing, the comparative example is of the same construction as the first exemplary embodiment. FIGS. 6A and 6B are diagrams illustrating the pressure condition and power control timing in the fixing device according to the first comparative example. In the first exemplary embodiment, the power supply to the heater 131 is started during the transition period T2 from the pressure release state P1 to a point in time before attaining the pressurization state P2, whereas, as illustrated in FIG. 6A, in the first comparative example, the power supply to the heater 131 is started after the pressurization state P2 has been attained.

FIG. 6B is a graph illustrating how the detected temperature of the sub thermistor 161, which is on the back surface side of the heater 131, is changed. Here, the length of the period T2 is 1.0 second, and the length of time from T3 to T1 is 0.2 seconds. As illustrated in FIG. 6B, the power supply to the heater 131 is started after the pressurization state P2 has been attained, so that the starting of the power supply is delayed by the transition period of time T2; the warm-up time T4 is 8.0 seconds, which is longer than that in the first exemplary embodiment.

Figure 7A:
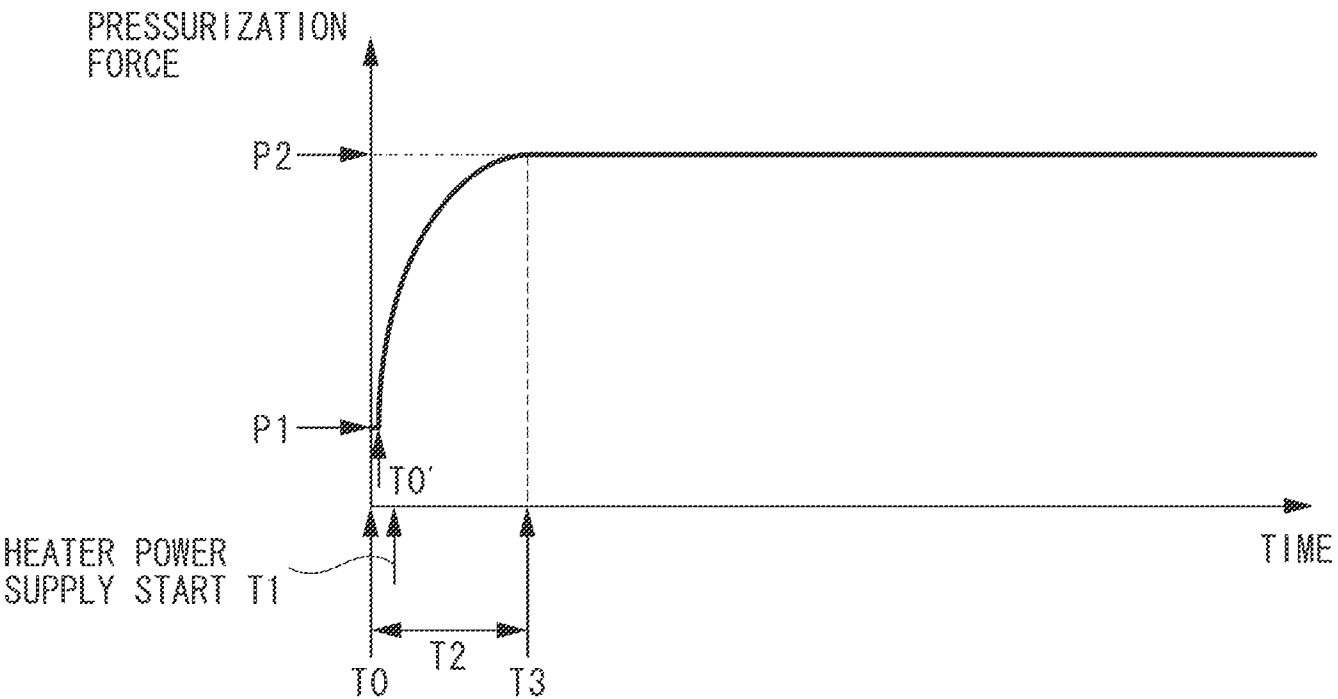
FIGS. 7A and 7B are diagrams illustrating the relationship between "pressure applied to nip portion" and "power supply timing" in a second exemplary embodiment.
Figure 7B:
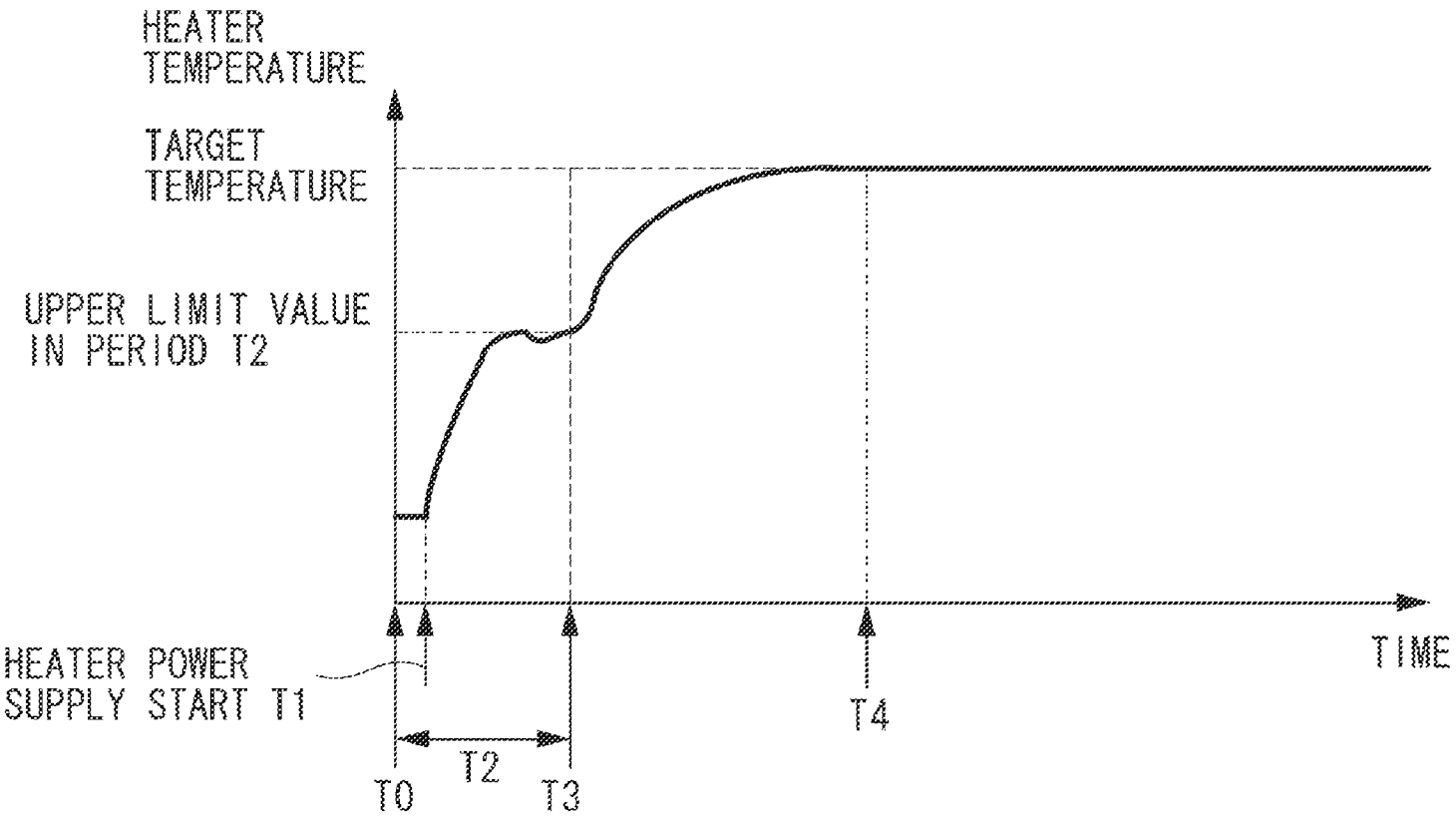

A second exemplary embodiment will be illustrated. In the present exemplary embodiment, the maximum initial power applied is 1200 W, which is larger than that in the first exemplary embodiment; apart from this, the present exemplary embodiment is of the same construction as the first exemplary embodiment. FIGS. 7A and 7B are diagrams illustrating the pressure condition and power control timing in the fixing device according to the second exemplary embodiment. As illustrated in FIG. 7A, as in the first exemplary embodiment, the power supply to the heater 131 is started before the pressurization state P2 is attained.

FIG. 7B is a graph illustrating how the detection temperature of the sub thermistor 161, which is on the back surface side of the heater 131, is changed in this case. In the second exemplary embodiment, the amount of the initial power applied is larger than that in the first exemplary embodiment, so that, as illustrated in FIG. 7B, the detection temperature of the sub thermistor 161 increases more abruptly than in the first exemplary embodiment. Thus, during the transition period T2, the power supply is controlled such that the temperature upper limit value of the heater 131 may not be exceeded. When the pressurization state P2 is attained, transition is effected from the temperature upper limit value during the transition period to the target temperature at the time of fixing processing. In the second exemplary embodiment, owing to the large amount of power applied, the warm-up period T4 is 4.0 seconds.

While in the present exemplary embodiment described above the operation is started with the heater 131 being at room temperature, also in the state in which the heater 131 has been warmed, it is possible to perform warming-up from the pressure release state P1 through the same control. On the other hand, when a print signal is input with the fixing device being in the pressurization state P2, the maximum power of 1200 W may be applied from the start of electricity supply to the heater 131.

As described above, in the present exemplary embodiment, a printing start signal is input to the image forming apparatus, and the electricity supply to the heater is started by the power control unit during the transition period from the pressure release state to a point in time before the attaining of the pressurization state, with the power supply being controlled such that the heater temperature during this transition period does not exceed a fixed temperature, whereby it is possible to provide an image forming apparatus helping to prevent heater cracking and to further shorten the warm-up time.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-255296 filed Nov. 15, 2010, which is hereby incorporated by reference herein in its entirety.

What is claimed is:

1. An image forming apparatus comprising:

an image forming unit configured to form an unfixed image on a recording material;

a fixing unit including an endless belt, a heater held in contact with an inner surface of the endless belt, a pressurization roller configured to form a fixing nip portion for pinching and conveying the recording material together with the heater via the endless belt, and a pressure changing mechanism configured to effect switching between a pressurization state in which a pressure, at a time of fixing processing, is applied to the fixing nip portion and a pressure release state in which the pressure applied to the fixing nip portion is released;

a first temperature detection element configured to detect an endless belt temperature of the endless belt;

a second temperature detection element configured to detect a heater temperature of the heater; and a power control unit configured to control a supply of power to the heater, wherein, in response to a print signal being input to effect transition from the pressure release state to the pressurization state, the power control unit starts the supply of power to the heater during a transition period before the pressurization state is attained and controls the supply of power to the heater such that a heater temperature does not exceed a predetermined upper limit temperature during the transition period, and wherein the power control unit controls the supply of power to the heater according to the heater temperature detected by the second temperature detection element until the heater temperature attains a target temperature at the time of fixing processing, and controls the supply of power to the heater according to the endless belt temperature detected by the first temperature detection element after the heater temperature has attained the target temperature.

2. The image forming apparatus according to claim 1, wherein the endless belt is rotatably driven by the pressurization roller with a frictional force exerted at the fixing nip portion.

3. The image forming apparatus according to claim 1, wherein the power control unit controls the supply of power to the heater by proportional and integral control during the transition period.

4. The image forming apparatus according to claim 1, wherein the predetermined upper limit temperature during the transition period is different from a predetermined upper limit temperature during the fixing processing.

5. An image forming apparatus comprising:

an image forming unit configured to form an unfixed image on a recording material;

a fixing unit including an endless belt, a heater held in contact with an inner surface of the endless belt, a pressurization roller configured to form a fixing nip portion for pinching and conveying the recording material together with the heater via the endless belt, and a pressure changing mechanism configured to effect switching between a pressurization state in which a pressure, at a time of fixing processing, is applied to the fixing nip portion and a pressure release state in which the pressure applied to the fixing nip portion is released; and a power control unit configured to control a supply of power to the heater, wherein, in response to a print signal being input to effect transition from the pressure release state to the pressurization state, the power control unit starts the supply of power to the heater during a transition period before the pressurization state is attained and controls the supply of power to the heater such that a heater temperature does not exceed a predetermined upper limit temperature during the transition period, and wherein immediately after the print signal is input, the image forming apparatus starts to effect transition from the pressure release state to the pressurization state.

6. The image forming apparatus according to claim 5, wherein the endless belt is rotatably driven by the pressurization roller with a frictional force exerted at the fixing nip portion.

7. The image forming apparatus according to claim 5, wherein the power control unit controls the supply of power to the heater by proportional and integral control during the transition period.

8. The image forming apparatus according to claim 5, wherein the predetermined upper limit temperature during the transition period is different from a predetermined upper limit temperature during the fixing processing.

9. An image forming apparatus comprising:

an image forming unit configured to form an unfixed image on a recording material;

a fixing unit including an endless belt, a heater held in contact with an inner surface of the endless belt, a roller configured to form a fixing nip portion for pinching and conveying the recording material together with the endless belt, and a pressure changing mechanism configured to effect switching between a pressurization state in which a pressure, at a time of fixing processing, is applied to the fixing nip portion and a pressure release state in which the pressure applied to the fixing nip portion is released;

a first temperature detection element configured to detect a temperature of the endless belt;

a second temperature detection element configured to detect a temperature of the heater; and a power control unit configured to control a power to be supplied to the heater, wherein the power control unit controls a power to be supplied to the heater according to the temperature detected by the first temperature detection element during the fixing processing, wherein, in response to a print signal being input to effect transition from the pressure release state to the pressurization state, the power control unit starts the supply of power to the heater during a transition period before the pressurization state is attained and controls a power to be supplied to the heater such that the temperature of the heater does not exceed a predetermined upper limit temperature during the transition period, and wherein the power control unit controls a power to be supplied to the heater according to the temperature detected by the second temperature detection element during the transition period.

10. The image forming apparatus according to claim 9, wherein the endless belt is rotatably driven by the roller with a frictional force exerted at the fixing nip portion.

11. The image forming apparatus according to claim 9, wherein the power control unit controls a power to be supplied to the heater by proportional and integral control during the transition period.

12. The image forming apparatus according to claim 9, wherein the predetermined upper limit temperature during the transition period is different from a predetermined upper limit temperature during the fixing processing.

13. An image forming apparatus comprising:

an image forming unit configured to form an unfixed image on a recording material;

a fixing unit including an endless belt, a heater held in contact with an inner surface of the endless belt, a roller configured to form a fixing nip portion for pinching and conveying the recording material together with the endless belt, and a pressure changing mechanism configured to effect switching between a pressurization state in which a pressure, at a time of fixing processing, is applied to the fixing nip portion and a pressure release state in which the pressure applied to the fixing nip portion is released; and a power control unit configured to control a power to be supplied to the heater, wherein, in response to a print signal being input to effect transition from the pressure release state to the pressurization state, the power control unit starts the supply of power to the heater during a transition period before the pressurization state is attained and controls a power to be supplied to the heater such that the temperature of the heater does not exceed a predetermined upper limit temperature during the transition period, and wherein the power control unit controls a power to be supplied to the heater after the pressurization state is attained so that the temperature of the heater rises faster than immediately before the pressurization state is attained.

14. The image forming apparatus according to claim 3, wherein the endless belt is rotatably driven by the roller with a frictional force exerted at the fixing nip portion.

15. The image forming apparatus according to claim 13, wherein the power control unit controls a power to be supplied to the heater by proportional and integral control during the transition period.

16. The image forming apparatus according to claim 13, wherein the predetermined upper limit temperature during the transition period is different from a predetermined upper limit temperature during the fixing processing.

* * * * *